US007145584B2

(12) United States Patent
Terao et al.

(10) Patent No.: US 7,145,584 B2
(45) Date of Patent: Dec. 5, 2006

(54) PRINTER HAVING COMPACT THERMAL HEAD

(75) Inventors: Hirotoshi Terao, Fukushima-ken (JP); Tomoko Wauke, Fukushima-ken (JP); Hisashi Hoshino, Fukushima-ken (JP); Tsuneyuki Sasaki, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 136 days.

(21) Appl. No.: 11/042,262

(22) Filed: Jan. 25, 2005

(65) Prior Publication Data

US 2005/0162502 A1 Jul. 28, 2005

(30) Foreign Application Priority Data

Jan. 26, 2004 (JP) ..... 2004-017081

(51) Int. Cl.
*B41J 2/335* (2006.01)

(52) U.S. Cl. ..... 347/200

(58) Field of Classification Search ..... 347/200, 347/201, 202–203, 204–209, 211
See application file for complete search history.

(56) References Cited

U.S. PATENT DOCUMENTS 6,339,443 B1 * 1/2002 Nakanishi et al. ..... 347/200
6,437,813 B1 8/2002 Nishimura
6,867,792 B1 * 3/2005 Hoshino et al. ..... 347/218
6,972,782 B1 * 12/2005 Terao et al. ..... 347/203

FOREIGN PATENT DOCUMENTS

JP 402231153 A * 9/1990
JP 2002-254717 9/2002

* cited by examiner

*Primary Examiner*—K. Feggins
(74) *Attorney, Agent, or Firm*—Brinks Hofer Gilson & Lione

(57) ABSTRACT

A printer having a thermal head disposed such that when heater elements are in contact with a platen, the following formulas are satisfied: $H1 \leqq H \leqq H_{max}$; $H_{max}=(H1+H2)=L \tan(\theta 1+\theta 3)$; and $\theta'=(\theta 2-\theta 1)=(3°\pm 1°)$. Length L is between a first line perpendicular to a top-substrate-surface and extending through a contact point between the heater elements and the platen, and a second line perpendicular to the top-substrate-surface and extending through a peak of a sealing member; height H is from the top-substrate-surface to the peak; height H1 is from the top-substrate-surface to a tangent between the platen and the heater elements; height H2 is from the tangent to a conveying path of a recording medium; angle θ1 is between the tangent and the top-substrate-surface; θ2 denotes a slope angle of a projection from the tangent; angle θ3 is between the tangent and the conveying path; and θ' denotes a head-returning angle.

6 Claims, 1 Drawing Sheet

$H1 \leqq H \leqq H_{max}$ (FORMULA 1)
$H_{max}=H1+H2=L \tan(\theta 1+\theta 3)$ (FORMULA 2)
$\theta'=\theta 2-\theta 1=3°\pm 1°$ (FORMULA 3)
$L \leqq 5(mm)$ (FORMULA 4)
$2° \leqq \theta 2 \leqq 15°$ (FORMULA 5)
$0° \leqq \theta 3 \leqq 15°$ (FORMULA 6)

$H1 \leqq H \leqq H_{max}$ (FORMULA 1)

$H_{max} = H1 + H2 = L \tan(\theta 1 + \theta 3)$ (FORMULA 2)

$\theta' = \theta 2 - \theta 1 = 3° \pm 1°$ (FORMULA 3)

$L \leqq 5(mm)$ (FORMULA 4)

$2° \leqq \theta 2 \leqq 15°$ (FORMULA 5)

$0° \leqq \theta 3 \leqq 15°$ (FORMULA 6)

PRINTER HAVING COMPACT THERMAL HEAD

This application claims the benefit of priority to Japanese Patent Application No. 2004-017081 filed on Jan. 26, 2004 herein incorporated by reference.

BACKGROUND OF THE INVENTION

1. Field of the Invention

The present invention relates to printers provided with thermal heads having a reduced dimension in a direction perpendicular to the arrayed direction of heater elements.

2. Description of the Related Art

In a typical thermal printer, a thermal head defining a recording head is provided with a substrate on which a plurality of heater elements formed of an exothermic resistor is arrayed. Based on recording data, electricity is selectively supplied to the heater elements to generate heat in the selected heater elements so that a desired recording operation can be performed on various types of recording media. For example, the heated heater elements melt the ink contained in an ink ribbon in order to heat-transfer the ink to, for example, a sheet of plain paper or a transparency sheet, or develop colors on a sheet of thermal recording paper.

In such a conventional thermal head, an insulating layer is disposed on the surface of the exothermic substrate. An end portion of the top surface of the insulating layer is provided with a projection having a predetermined height. Moreover, an exothermic resistor is disposed over the projection of the insulating layer. The side of the exothermic resistor closer to the front end of the substrate and the side closer to the base end are respectively provided with a common electrode and independent electrodes for supplying power to the exothermic resistor. The region of the exothermic resistor between the common electrode and the independent electrodes defines a plurality of heater elements arrayed across the region in a dot-like manner.

Moreover, the base end portion of the substrate is provided with a driver-IC chip connected with the common electrode and the independent electrodes. The driver-IC chip will be referred to as an IC chip hereinafter. The IC chip is coated with a protective sealing member composed of sealing resin.

Such a conventional thermal head is disclosed in, for example, Japanese Unexamined Patent Application Publication No. 2003-165240. According to such a thermal head, the substrate is attached to a printer via a head attachment-base in a manner such that when the head attachment-base is rotated, the heater elements become in contact with and pressed against a platen via a medium.

Like other electric devices, it is in great demand that the size and the cost be reduced in printers provided with the thermal head described above. Such size reduction of printers can be achieved by dramatically reducing the dimension of the substrate of the thermal head in a direction perpendicular to the arrayed direction of the heater elements. Furthermore, by increasing the number of substrates used for thermal heads that are cut and obtained from a single sheet of a mother substrate, the cost reduction can be achieved.

If the dimension of the substrate in the direction perpendicular to the arrayed direction of the heater elements is reduced, the sealing member for coating the IC chip has to be disposed very close to the heater elements on the top surface of the substrate. This means that the sealing member disposed on the thermal head will be positioned in a conveying path of media used for the recording operation, such as paper and ink ribbon. Thus, by coming into contact with the media, the sealing member can interfere with the conveying path, which may lead to improper conveying of the media. Moreover, a direct contact between the sealing member and the media can cause degradation of the recording quality. Furthermore, if the sealing member comes into contact with the platen, the heater elements are prevented from properly pressing against the media. In such a case, high quality recording cannot be achieved.

SUMMARY OF THE INVENTION

Accordingly, it is an object of the present invention to provide a printer having a thermal head in which a dimension of a substrate in a direction perpendicular to the arrayed direction of heater elements is reduced while still achieving proper recording operation and high-quality recording.

In order to achieve the above-mentioned object, the present invention provides a printer provided with a thermal head which is disposed in the printer in a manner such that when heater elements are in contact with a platen, the following conditional formulas are satisfied:

$$H1 \leqq H \leqq H_{max}; \quad \text{Formula 1:}$$

$$H_{max} = H1 + H2 = L \tan(\theta 1 + \theta 3); \text{ and} \quad \text{Formula 2:}$$

$$\theta' = \theta 2 - \theta 1 = 3 \pm 1(°). \quad \text{Formula 3:}$$

Furthermore, the thermal head preferably includes an IC chip connected with independent electrodes and a common electrode provided in the thermal head; and a sealing member composed of sealing resin and covering the IC chip.

Furthermore, the thermal head has a size such that a dimension of the thermal head in a direction perpendicular to the arrayed direction of the heater elements is preferably 10 mm or less, and is preferably disposed in the printer such that the following conditional formulas are satisfied:

$$L \leqq 5 \text{ (mm)} \quad \text{Formula 4:}$$

$$2° \theta 2 \leqq 15°. \quad \text{Formula 5:}$$

Furthermore, the thermal head is preferably disposed such that the following conditional formula is satisfied:

$$0° \leqq \theta 3 \leqq 15°. \quad \text{Formula 6:}$$

In the above conditional formulas, L denotes a length between a first perpendicular line and a second perpendicular line in the arrayed direction of the heater elements, the first perpendicular line being perpendicular to the top surface of the substrate and extending through a contact point between the heater elements and the platen, the second perpendicular line being perpendicular to the top surface of the substrate and extending through a peak point of the sealing member; H denotes a height from the top surface of the substrate to the peak point of the sealing member; H1 denotes a height measured along the second perpendicular line from the top surface of the substrate to a tangent line between the platen and the heater elements, the second perpendicular line being perpendicular to the top surface of the substrate and extending through the peak point of the sealing member; H2 denotes a height measured along the second perpendicular line from the tangent line between the platen and the heater elements to a conveying path of a medium used for recording disposed the closest to the thermal head; θ1 denotes an angle formed between the tangent line of the platen and the heater elements and the top surface of the substrate; θ2 denotes a slope angle of the projection with respect to the tangent line of the platen and the heater elements; θ3 denotes an angle formed between the tangent line of the platen and the heater elements and the conveying path of the medium used for recording disposed the closest to the thermal head; and θ' denotes a head-returning angle.

According to the printer of the present invention, the thermal head is made compact by reducing the dimension of the substrate of the thermal head in the direction perpendicular to the arrayed direction of the heater elements. In such a case, even if the sealing member is disposed close to the heater elements, the thermal head is disposed in the printer such that the sealing member is prevented from interfering with the conveying path of media used for the recording operation, such as an ink ribbon and recording paper. Accordingly, this thoroughly prevents problems related with an improper recording operation due to, for example, an interfered conveying path of the media, or the degradation of recording quality due to a direct contact between the sealing member and the media.

DESCRIPTION OF THE PREFERRED EMBODIMENTS

Embodiments of the present invention will now be described with reference to the drawings.

Figure 1:
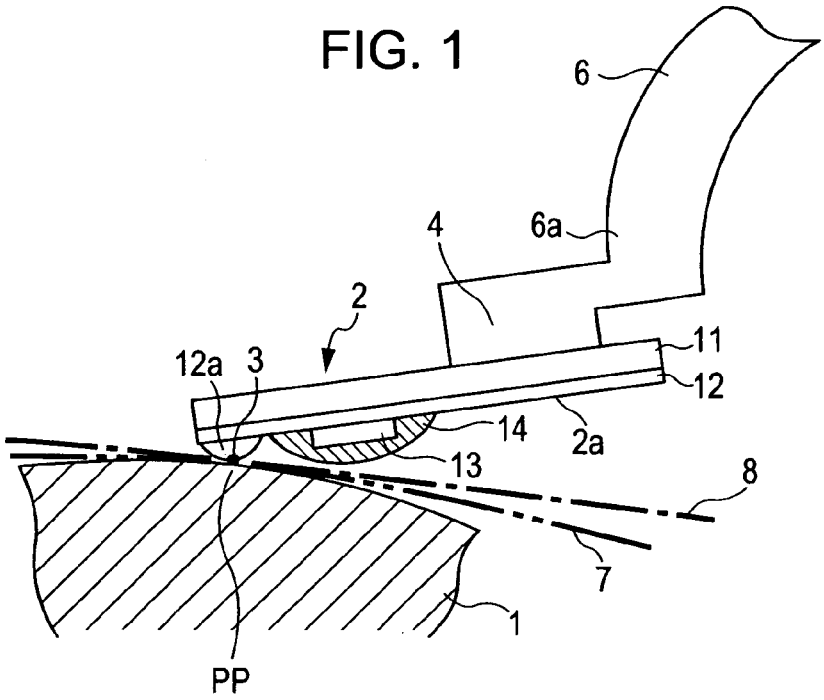
FIG. 1 is an enlarged schematic diagram illustrating a structure of a relevant section of a printer according to the present invention.

FIG. 1 is a front view illustrating a relevant section of a line printer in a recording state according to an embodiment of the present invention. The line printer will simply be referred to as a printer hereinafter.

A main body of the printer according to this embodiment contains a rotatable platen roller 1 defining a platen. A thermal head 2 defining a recording head is disposed above the platen roller 1. Specifically, the thermal head 2 extends in a direction parallel to the axial direction, i.e. the longitudinal direction, of the platen roller 1, and has a recording surface 2*a* across which a plurality of heater elements 3 are arrayed such that the heater elements 3 face the outer periphery surface of the platen roller 1.

The thermal head 2 is attached to an undersurface of a head attachment-base 4 composed of a lightweight metallic material having a high exothermic property, i.e. thermal conductivity, such as an aluminum alloy. The head attachment-base 4 is attached to a front end 6*a* of a head lever 6. A base end, not shown in the drawing, of the head lever 6 is axially supported by a supporting shaft, also not shown in the drawing. By rotating the head lever 6 about the supporting shaft in response to a driving force from a driving source, not shown in the drawing, the thermal head 2 attached to the head attachment-base 4 can be selectively set between two positions, namely, a head-down position in which the thermal head 2 is in contact with and pressed against the platen roller 1 and a head-up position in which the thermal head 2 is not in contact with the platen roller 1.

In the head-down state shown in FIG. 1, a sheet of paper 7 and an ink ribbon 8 disposed in that order from the platen roller 1 are supplied into the space between the platen roller 1 and the thermal head 2. In this head-down state in which the thermal head 2 presses against the platen roller 1 with a predetermined contact force, the contact point between the thermal head 2 and the platen roller 1 defines a recording point PP at which the ink in the ink ribbon 8 is transferred to the paper 7 to be recorded on.

The ink ribbon 8 has a width that is substantially equivalent to the recording width, which corresponds to the recording range in the row direction of the paper 7. Moreover, the ink ribbon 8 is movable together with the paper 7. When the recording operation is performed, the ink ribbon 8 is conveyed in response to the movement of the paper 7 from the upstream side of the recording point PP, i.e. the right side of the recording point PP in FIG. 1, to the downstream side of the recording point PP, i.e. the left side of the recording point PP in FIG. 1, so as to be taken up in a sequential manner.

The structure of the thermal head 2 of the printer according to this embodiment and the structure for attaching the thermal head 2 to the printer will now be described.

The thermal head 2 of the printer according to this embodiment includes a substrate 11 having a high exothermic property, and an insulating layer 12 which is disposed over the substrate 11 and is formed of, for example, a glaze having a high insulative property. An end portion of the top surface of the insulating layer 12 is provided with a projection 12*a* whose surface is processed by, for example, photolithography so that the projection 12*a* partially has a height within a range of 5 to 50 μm. Here, the term "top surface" refers to the undersurface of the insulating layer 12 shown in FIG. 1. An exothermic resistor composed of, for example, Ta—N or Ta—$SiO_2$, which is not shown in the drawing, is disposed over the projection 12*a* of the insulating layer 12. The side of the exothermic resistor closer to the front end of the substrate 11 and the side closer to the base end are respectively provided with a common electrode and independent electrodes, which are not shown in the drawing, for supplying power to the exothermic resistor. Here, the terms "front end" and "base end" are respectively defined as the left and right sides of the substrate 11 in FIG. 1. Such electrodes are patterned by sputtering and photolithography techniques using, for example, Al, Cu, or Au. The region of the exothermic resistor between the common electrode and the independent electrodes define the heater elements 3 which are arrayed across the region in a dot-like manner.

Furthermore, in order to prevent oxidation and abrasion, the heater elements 3, the common electrode, and the independent electrodes are coated with a protective layer, which is not shown in the drawing, composed of hard ceramics having high oxidation resistance and abrasion resistance properties, such as Si—O—N and SiAlON. The protective layer is formed to a predetermined thickness by, for example, a sputtering technique. Moreover, the substrate 11 is provided with a driver-IC chip 13 connected with the common electrode and the independent electrodes. The driver-IC chip 13 will be referred to as an IC chip 13 hereinafter. The IC chip 13, for example, controls the electric pulse of voltage supplied to the heater elements 3 in order to regulate the heat output from the heater elements 3. One terminal of the IC chip 13 is connected with an external terminal formed of, for example, an FPC (flexible substrate) extending from a section of the insulating layer 12 on the substrate 11. The IC chip 13 is coated with a protective sealing member 14 composed of sealing resin.

Figure 2:
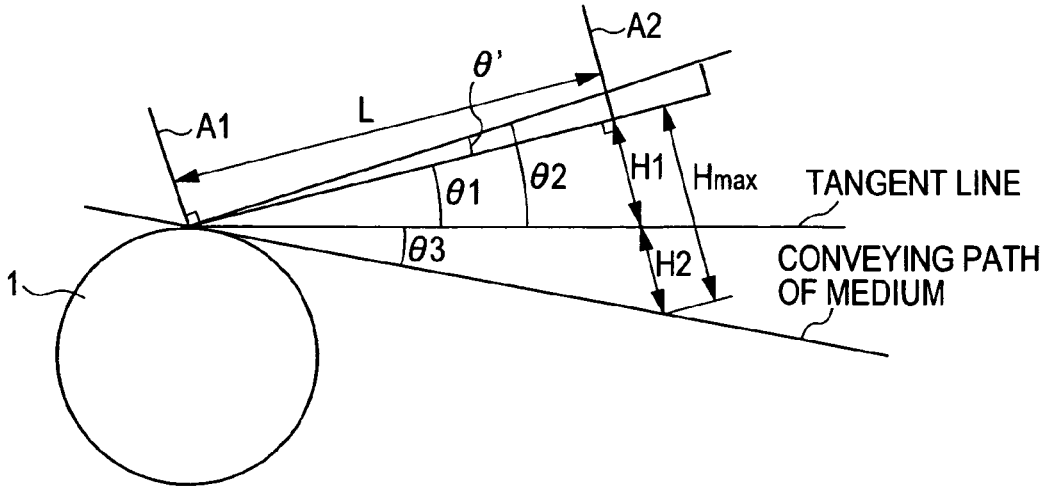
FIG. 2 is a schematic diagram illustrating the dimensions and angles of components substituted into conditional formulas.

Referring to FIG. 2, the thermal head 2 according to this embodiment is attached to the head attachment-base 4 in a manner such that when the heater elements 3 are in contact with the platen roller 1 during the recording operation, the following conditional formulas are satisfied:

$$H1 \leqq H \leqq H_{max} \quad \text{Formula 1}$$

$$H_{max} = H1 + H2 = L \tan(\theta 1 + \theta 3) \quad \text{Formula 2}$$

$$\theta' = \theta 2 - \theta 1 = 3 \pm 1(°) \quad \text{Formula 3}$$

In the conditional formulas above, L denotes the length between a perpendicular line A1 and a perpendicular line A2 in the arrayed direction of the heater elements 3. Specifically, the perpendicular line A1 is perpendicular to the top surface of the substrate 11 and extends through a contact point between the heater elements 3 and the platen roller 1, whereas the perpendicular line A2 is perpendicular to the top surface of the substrate 11 and extends through a peak point of the sealing member 14. Such a length will be referred to as length L hereinafter.

On the other hand, in the conditional formulas above, H denotes the height from the top surface of the substrate 11 to the peak point of the sealing member 14. H1 denotes the height measured along the perpendicular line A2 from the top surface of the substrate 11 to the tangent line between the platen roller 1 and the heater elements 3, the perpendicular line A2 being perpendicular to the top surface of the substrate 11 and extending through the peak point of the sealing member 14. H2 denotes the height measured along the perpendicular line A2 from the tangent line between the platen roller 1 and the heater elements 3 to the conveying path of one of the media 7 and 8 used for recording disposed the closest to the thermal head 2. In this case, since it is assumed that the heater elements 3 and the platen roller 1 are not directly in contact with each other during the recording operation, the tangent line between the platen roller 1 and the heater elements 3 mentioned above strictly implies a tangent line extending from a contact point between the heater elements 3 of the thermal head 2 and one of the media 7 and 8 when the thermal head 2 is at the head-down position.

On the other hand, θ1 denotes the angle formed between the tangent line of the platen roller 1 and the heater elements 3 and the top surface of the substrate 11. Such an angle will be referred to as a head-spacing angle hereinafter. θ2 denotes the slope angle of the projection 12*a* with respect to the tangent line. θ3 denotes the angle formed between the tangent line of the platen roller 1 and the heater elements 3 and the conveying path of one of the media 7 and 8 disposed closer to the thermal head 2. In this embodiment, since the ink ribbon 8 is disposed closer to the thermal head 2, the angle θ3 is between the tangent line and the conveying path of the ink ribbon 8. θ' denotes the head-returning angle. Referring to Formula 3, the head-returning angle θ' is the difference of the slope angle θ2 of the projection 12*a* and the angle θ1 formed between the tangent line of the platen roller 1 and the heater elements 3 and the top surface of the substrate 11.

The following experimental result is the basis for proving why the angle θ' in Formula 3 is equal to 3±1(°).

In the thermal head 2 used in the experiment, the length L was 1.4 mm, the height H from the top surface of the substrate 11 to the peak point of the sealing member 14 was 0.3 mm, and the slope angle θ2 of the projection 12*a* of the insulating layer 12 was set at 7°. Using such a thermal head 2, the recording condition was observed while adjusting the head-spacing angle θ1. As is apparent from the table shown below, good recording results were obtained when the head-spacing angle θ1 was set at 3° and 5°. These results prove that θ'=3±1(°) in Formula 3 stands.

TABLE 1

| θ2 (°) | θ1 (°) | RESULTS |
|---|---|---|
| 7 | 9 | BAD |
| | 7 | FAULTS DETECTED |
| | 5 | GOOD |
| | 3 | GOOD |
| | 2 | FAULTS DETECTED |
| | 0 | BAD |

By satisfying the above conditional formulas, the sealing member 14 is prevented from interfering with the conveying path of media used for the recording operation, such as the ink ribbon 8 and the paper 7. Accordingly, this prevents problems related with the improper conveying of the media 7 and 8 or the degradation of recording quality due to a direct contact between the sealing member 14 and the medium 7 or 8.

Furthermore, the thermal head 2 in the printer according to this embodiment has a compact size such that the dimension of the thermal head 2 in the arrayed direction of the heater elements 3 is equal to or less than 60 mm, and the dimension in a direction perpendicular to the arrayed direction is equal to or less than 10 mm. The length L is therefore equal to or less than 5 mm.

$$L \leqq 5 \text{ (mm)} \quad \text{Formula 4}$$

Furthermore, according to the structure for attaching the thermal head 2 to the printer of this embodiment, the thermal head 2 is preferably set so as to satisfy the following conditional formulas:

$$2(°) \leqq \theta 2 \leqq 15(°) \quad \text{Formula 5}$$

$$0(°) \leqq \theta 3 \leqq 15(°) \quad \text{Formula 6.}$$

Accordingly, by satisfying these conditional formulas related with the slope angle θ2 of the projection 12*a* and the angle θ3 formed between the tangent line of the platen roller 1 and the heater elements 3 and the conveying path of one of the media 7 and 8 disposed closer to the thermal head 2, i.e. the conveying path of the ink ribbon 8 in this embodiment, even if the thermal head 2 in the printer of this embodiment has a compact size in which the sealing member 14 is disposed extremely close to the heater elements 3 due to the dimension of the thermal head 2 in the direction perpendicular to the arrayed direction of the heater elements 3 being 10 mm or less and the length L being 5 mm or less, the sealing member 14 is prevented from interfering with the conveying path of media used for the recording operation, such as the ink ribbon 8 and the paper 7. Accordingly, this thoroughly prevents problems related with the improper conveying of the media 7 and 8, or the degradation of recording quality due to a direct contact between the sealing member 14 and the medium 7 or 8.

Furthermore, by setting the range of height of the sealing member 14 on the thermal head 2 so as to satisfy the above conditional formulas, the printer according to this embodiment can be fabricated easily.

The technical scope of the present invention is not limited to the above embodiment, and modifications are permissible within the scope and spirit of the present invention. For example, the sealing member does not necessarily have to be provided specifically for covering an IC chip, but may alternatively be provided for covering, for example, electrodes exposed on the surface of the substrate.

What is claimed is:

1. A printer provided with a thermal head, the thermal head comprising:

a substrate;

an insulating layer disposed over the substrate and including a projection in a portion of the insulating layer;

a plurality of heater elements arrayed on the projection and formed of an exothermic resistor; and independent electrodes and a common electrode for supplying power to the exothermic resistor, wherein at least a portion of a top surface of the substrate is coated with a protective sealing member, the sealing member being disposed closer to a base end of the substrate than the heater elements, wherein, in a state in which the heater elements are in contact with a platen disposed in a main body of the printer, the thermal head is attached to the main body such that the following conditional formulas are satisfied:

$$H1 \leqq H \leqq H_{max}; \quad \text{Formula 1:}$$

$$H_{max} = H1 + H2 = L \tan(\theta 1 + \theta 3); \text{ and} \quad \text{Formula 2:}$$

$$\theta' = \theta 2 - \theta 1 = 3 \pm 1(°) \quad \text{Formula 3:}$$

wherein L denotes a length between a first perpendicular line and a second perpendicular line in the arrayed direction of the heater elements, the first perpendicular line being perpendicular to the top surface of the substrate and extending through a contact point between the heater elements and the platen, the second perpendicular line being perpendicular to the top surface of the substrate and extending through a peak point of the sealing member, wherein H denotes a height from the top surface of the substrate to the peak point of the sealing member, wherein H1 denotes a height measured along the second perpendicular line from the top surface of the substrate to a tangent line between the platen and the heater elements, the second perpendicular line being perpendicular to the top surface of the substrate and extending through the peak point of the sealing member, wherein H2 denotes a height measured along the second perpendicular line from the tangent line between the platen and the heater elements to a conveying path of a medium used for recording disposed the closest to the thermal head, wherein θ1 denotes an angle formed between the tangent line of the platen and the heater elements and the top surface of the substrate, wherein θ2 denotes a slope angle of the projection with respect to the tangent line of the platen and the heater elements, wherein θ3 denotes an angle formed between the tangent line of the platen and the heater elements and the conveying path of the medium used for recording disposed the closest to the thermal head, and wherein θ' denotes a head-returning angle.

2. The printer according to claim 1, wherein the thermal head further comprises an IC chip connected with the independent electrodes and the common electrode, and wherein the IC chip is coated with the sealing member.

3. The printer according to claim 2, wherein the thermal head has a size such that a dimension of the thermal head in a direction perpendicular to the arrayed direction of the heater elements is 10 mm or less, and wherein the thermal head is attached to the main body of the printer such that the following conditional formulas are satisfied:

$$L \leqq 5 \text{ (mm)} \quad \text{Formula 4:}$$

$$2° \leqq \theta 2 \leqq 15° \quad \text{Formula 5.}$$

4. The printer according to claim 3, wherein the thermal head is attached to the main body of the printer such that the following conditional formula is satisfied:

$$0° \leqq \theta 3 \leqq 15° \quad \text{Formula 6.}$$

5. The printer according to claim 1, wherein the thermal head has a size such that a dimension of the thermal head in a direction perpendicular to the arrayed direction of the heater elements is 10 mm or less, and wherein the thermal head is attached to the main body of the printer such that the following conditional formulas are satisfied:

$$L \leqq 5 \text{ (mm)} \quad \text{Formula 4}$$

$$2° \leqq \theta 2 \leqq 15° \quad \text{Formula 5.}$$

6. The printer according to claim 5, wherein the thermal head is attached to the main body of the printer such that the following conditional formula is satisfied:

$$0° \leqq \theta 3 \leqq 15° \quad \text{Formula 6.}$$

* * * * *

UNITED STATES PATENT AND TRADEMARK OFFICE

CERTIFICATE OF CORRECTION

PATENT NO. : 7,145,584 B2
APPLICATION NO. : 11/042262
DATED : December 5, 2006
INVENTOR(S) : Hirotoshi Terao et al.

It is certified that error appears in the above-identified patent and that said Letters Patent is hereby corrected as shown below:

On the Title Page

In column 2, line 2, after "6,867,792" delete "B1" and substitute --B2-- in its place.

In column 2, line 3, after "6,972,782" delete "B1" and substitute --B2-- in its place.

In the Claims

Column 7, in claim 1, after line 18, delete the table in its entirety and substitute the following table in its place.

--Formula 1: $H1 \leq H \leq H_{max}$;
Formula 2: $H_{max} = H1 + H2 = L\tan(\theta 1 + \theta 3)$; and
Formula 3: $\theta' = \theta 2 - \theta 1 = 3 \pm 1(°)$--.

Column 8, in claim 3, after line 7, delete the table in its entirety and substitute the following table in its place.

--Formula 4: $L \leq 5$ (mm)
Formula 5: $2° \leq \theta 2 \leq 15°$--.

Column 8, in claim 4, after line 3, delete the table in its entirety and substitute the following table in its place.

--Formula 6: $0° \leq \theta 3 \leq 15°$--.

UNITED STATES PATENT AND TRADEMARK OFFICE

CERTIFICATE OF CORRECTION

PATENT NO. : 7,145,584 B2
APPLICATION NO. : 11/042262
DATED : December 5, 2006
INVENTOR(S) : Hirotoshi Terao et al.

It is certified that error appears in the above-identified patent and that said Letters Patent is hereby corrected as shown below:

In the Claims (cont'd)

Column 8, in claim 5, after line 7, delete the table in its entirety and substitute the following table in its place.

--Formula 4: $L \leq 5$ (mm)
Formula 5: $2° \leq \theta 2 \leq 15°$--

Column 8, in claim 6, after line 3, delete the table in its entirety and substitute the following table in its place.

--Formula 6: $0° \leq \theta 3 \leq 15°$--.

Signed and Sealed this

Third Day of June, 2008

JON W. DUDAS
*Director of the United States Patent and Trademark Office*